US006062206A

United States Patent [19]

Nelson et al.

[11] Patent Number: 6,062,206

[45] Date of Patent: May 16, 2000

[54] PCV HEATER AND METHOD FOR MANUFACTURING SAME

[75] Inventors: Kirk A. Nelson, Invergrove Heights; Brian E. Wicks, Edina; Gary C. Edwards, Apple Valley, all of Minn.

[73] Assignee: Phillips & Temro Industries Inc., Eden Prairie, Minn.

[21] Appl. No.: 09/127,060

[22] Filed: Jul. 31, 1998

Related U.S. Application Data

[63] Continuation-in-part of application No. 09/044,723, Mar. 19, 1998.

[51] Int. Cl.[7] ..... F02M 25/00

[52] U.S. Cl. ..... 123/573

[58] Field of Search ..... 123/572–573, 123/574, 41.86, 549, 556

[56] References Cited

U.S. PATENT DOCUMENTS

| | | | |
|---|---|---|---|
| 3,088,447 | 5/1963 | Henderson . | |
| 3,779,221 | 12/1973 | Gartner | 123/573 |
| 3,846,980 | 11/1974 | Depalma | 123/573 |
| 4,279,236 | 7/1981 | Dallman . | |
| 4,361,125 | 11/1982 | Igashira et al. . | |
| 4,390,000 | 6/1983 | Igashira et al. . | |
| 4,395,994 | 8/1983 | Goto et al. . | |
| 4,404,950 | 9/1983 | Dallman . | |
| 4,407,254 | 10/1983 | Kato et al. . | |
| 4,416,242 | 11/1983 | Kato et al. . | |
| 4,489,232 | 12/1984 | Wada et al. . | |
| 4,651,702 | 3/1987 | Nara et al. . | |
| 4,708,118 | 11/1987 | Rawlings | 123/573 |
| 4,768,493 | 9/1988 | Ohtaka et al. . | |
| 4,870,249 | 9/1989 | Kayanuma et al. . | |
| 5,024,203 | 6/1991 | Hill . | |
| 5,329,913 | 7/1994 | Suzuki et al. . | |
| 5,401,935 | 3/1995 | Smith et al. . | |

FOREIGN PATENT DOCUMENTS

| | | |
|---|---|---|
| 2432782 | 1/1976 | Germany . |

*Primary Examiner*—Marguerite McMahon
*Attorney, Agent, or Firm*—Harness, Dickey & Pierce, P.L.C.

[57] ABSTRACT

A PCV heater including a fitting having a plug and a heat sink coupled to the fitting. The fitting and the heat sink define a gas flow path having a first end and a second end. The second end of the gas flow path defines a discharge port and the heat sink is proximate to the discharge port. The heater also includes a heating element coupled to the plug and electrically connectable to a power source. The heating element thermally engages the heat sink to communicate heat from the heating element to the heat sink when the heating element is electrically connected to the power source.

20 Claims, 6 Drawing Sheets

PCV HEATER AND METHOD FOR MANUFACTURING SAME

This is a continuation-in-part of U.S. Pat. application No. 09/044,723, filed Mar. 19, 1998.

BACKGROUND OF THE INVENTION

1. Technical Field

The present invention relates generally to an electric heater for an internal combustion engine and, more particularly, to an electric heater for a positive crankcase ventilation system of an internal combustion engine.

2. Discussion

Positive crankcase ventilation (PCV) draws and feeds gases from the engine crankcase into the engine induction system such as at the intake manifold. Crankcase gases oftentimes include a fairly high percentage of unwanted constituents, such as hydrocarbons, resulting from blowby during engine operation. These unwanted constituents may be burned off after recirculation through the PCV system. A PCV valve normally positioned proximate to the crankcase regulates the flow through the PCV system into the intake manifold in relation to the engine load.

During cold weather operation of the engine, condensation problems can result in the area where the PCV system discharges gases into the intake manifold. More particularly, ambient air drawn into and through the air intake system during operation of the engine mixes with the PCV gases that have been warmed through combustion. Condensation occurs as the PCV gases cool in the mixing zone. If the ambient temperatures are sufficiently cold, the condensed liquid may freeze causing plugging of the PCV system and over-pressures in the crank case that ultimately may prevent proper engine operation.

Previous PCV heaters have failed to adequately address these freeze-up concerns. More particularly, a presently used PCV heater includes a stamped steel fitting having a steel cup integral with a steel tube. The steel cup is configured to be coupled to an appropriately sized opening in the intake manifold and the steel tube is connectable to a conduit that conveys the ventilated gases from the PCV valve to the fitting. In this device, the tube is heated by a resistance element that is wound about the base of the tube. The resistance element is generally turned twice about the tube and crossed over itself in close proximity to a previous turn. The conductive nature of the cup and tube as well as the proximity of the wires create an undesirably large frequency of shorting.

In heaters having a wrapped resistance wire as the heating element, design concerns specifically related to space constraints, heating capacity, power usage, and short circuiting must be balanced. In general, it would be desirable to optimize the number of wire turns to control the heating capacity of the unit. However, space constraints limit the number of turns that may be used without incurring an unacceptably high frequency or probability of shorting. A smaller diameter wire could be used to decrease the number of turns and improve on shorting. However, when smaller diameter wires are used, the total length of wire is shortened and the operating temperature within the wire is increased leading to a decrease in robustness and service life.

In addition to the above-described operational concerns, the previous heater is difficult to manufacture. More particularly, manufacture requires termination of the resistance wire to lead wires communicating with a power source, manually wrapping wires about the tube, overpotting the wrapped wires with a heat transfer epoxy, allowing the potting epoxy to cure for 30 to 45 minutes, covering the helically wound resistance element with a silicon epoxy to limit heat transfer away from the tube, and oven curing the silicon epoxy for 60 minutes. Oftentimes shorting concerns require dipping of the resistance wires in a soft cure heat transfer epoxy prior to wrapping. The epoxy is then cured for approximately thirty (30) to forty-five (45) minutes. This labor intensive and time consuming procedure increases manufacturing costs and limits the capacity of manufacture.

In view of the above, a need exists for an improved PCV heater. Improved PCV heaters would advantageously address each of the above concerns including a reduced frequency of shorting, more simplified and inexpensive manufacturing procedures, concentrate the heat in the area of freeze-up, thermally isolate the heat sink of the heater from the engine, and generate a given amount of heat with better efficiency thereby lowering required wattages and saving energy.

SUMMARY OF THE INVENTION

Accordingly, the present invention relates generally to a PCV heater that addresses freeze-up concerns in a PCV system. More particularly, the PCV heater includes a fitting having a plug and a heat sink coupled to the fitting. The fitting and the heat sink define a gas flow path having a first end and a second end. The second end of the gas flow path defines a discharge port and the heat sink is proximate to the discharge port. The heater also includes a heating element coupled to the fitting and electrically connectable to a power source. The heating element thermally engages the heat sink to communicate heat thereto when the heating element is electrically connected to the power source. A method for manufacturing the PCV heater includes the steps of placing a heat sink into a mold cavity, coupling a heating element to the heat sink, electrically connecting a first lead wire and a second lead wire to the heating element, and providing a high temperature plastic to the mold cavity to overmold the heat sink and the heating element.

BRIEF DESCRIPTION OF THE DRAWINGS

Other objects and advantages of the invention will become apparent to one skilled in the art upon reading the following specification and subjoined claims and upon reference to the drawings in which:

DETAILED DESCRIPTION

Several embodiments of the present invention will now be described with reference to FIGS. 1–8 and FIGS. 11–13. An exemplary method for forming the various embodiments of the present invention will then be described with reference to FIGS. 9 and 10. It should be understood that while the PCV heater and accompanying components are illustrated and described in a specific location on the illustrated engine, various alternate locations may be used without departing from the scope of the invention as defined by the appended claims. Those skilled in the art will appreciate that each embodiment of the PCV heater is positionable proximate to the area or zone where the cold ambient air mixes with the gases in the PCV system as hereinafter described. Those skilled in the art will further appreciate from the following description that the PCV heater of the present invention provides numerous advantages over the prior art including the use of a heat sink to concentrate heat at the discharge port of the heater to achieve improved resistance to freeze-up at reduced watt density, lower energy consumption, and cooler heating element operating temperatures. These and other advantages of the present invention are described above as well as in this detailed description.

Figure 1:
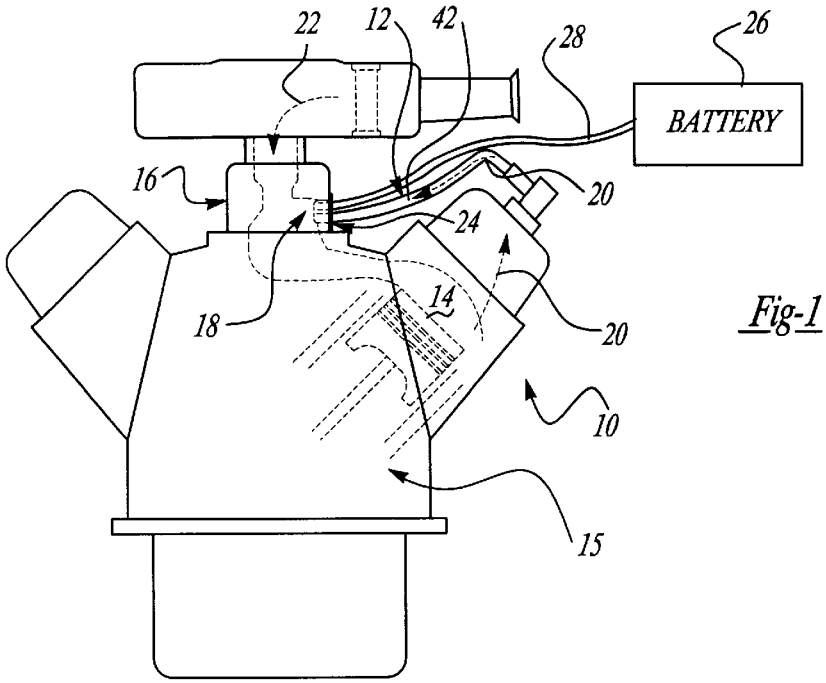
FIG. 1 is an elevational view of an internal combustion engine having a PCV system.

An engine 10 is illustrated in FIG. 1 to include a PCV system 12 in communication with a crankcase 15 and intake manifold 16. One skilled in the art will appreciate that PCV system 12 may be positioned in a variety of locations in communication with the crankcase gases. Such locations include a valve cover position as shown in FIG. 1 or a direct connection to crankcase 15. The general operation of PCV systems are also generally known in the art. Reference may be made to U.S. Pat. No. 4,768,493 issued Sep. 6, 1988 to Ohtaka et al., the disclosure of which is hereby incorporated by reference, for a more complete description of such systems. A mixing zone generally indicated by reference numeral 18 is formed generally at intake manifold 16 and, more particularly, in the proximity of the confluence of the recirculated gases indicated by flow arrows 20 and the ambient air indicated by flow arrow 22. PCV heater 24 includes an electric heater element that is connected to a power source such as battery 26 via a lead wire harness 28. Heater 24 is positioned at or slightly upstream of mixing zone 18 along circulated gas flow path 20 to prevent freezing of the condensed moisture in this area and thereby reduce the probability of plugging of the PCV system and the resulting over-pressures in the crankcase.

The illustrated position of the PCV heater 24 relative to intake manifold 16 is provided for exemplary purposes. Those skilled in the art will appreciate that heater 24 is preferably positioned at the PCV system discharge point corresponding to the air inlet for the engine intake in order to provide proper PCV gas mixing and conveyance to all engine cylinders. This air inlet may include the illustrated intake manifold as well as other generally recognized alternatives such as the throttle body or carburetor.

Figure 2:
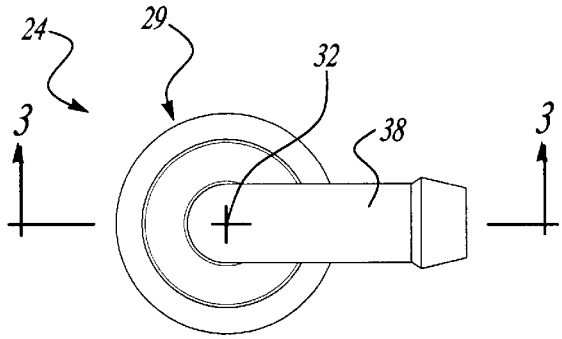
FIG. 2 is a top plan view of a PCV fitting according to the present invention.
Figure 3:
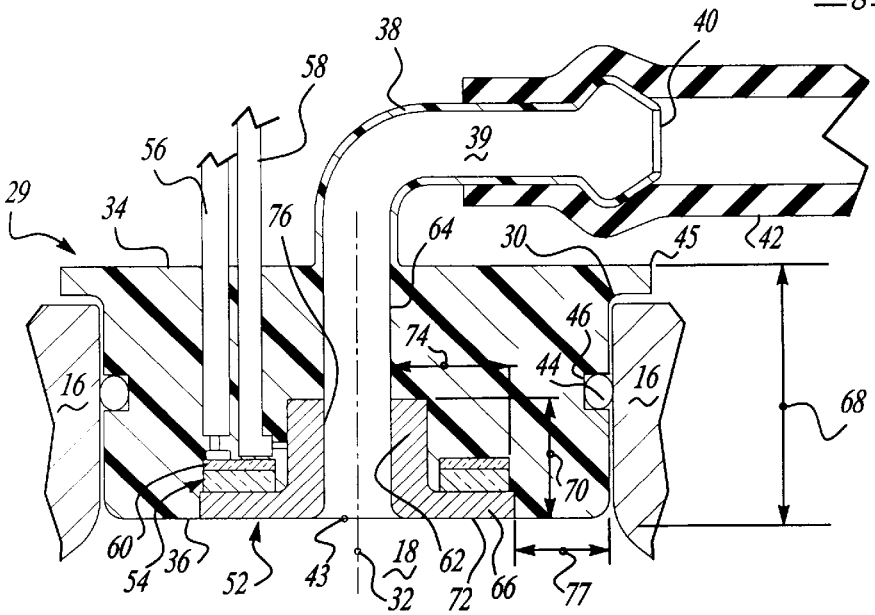
FIG. 3 is a sectional view taken along the line 3—3 of FIG. 2 illustrating a first embodiment of the PCV heater.

The structure and operation of various embodiments of a PCV heater according to the present invention will now be described in detail with reference to FIGS. 2–8 and 11–13. As shown in FIGS. 2 and 3, PCV heater 24 includes a fitting 29 having a plug 30 that is generally cylindrical about an axis 32 and that includes an upper end 34 and a lower end 36. Fitting 29 also includes a flow tube 38 extending from plug 30. The plug, flow tube, and a heat sink 52 define a flow passage 39 extending from a first tube end 40 to a discharge port 43 (FIG. 3). As illustrated in FIGS. 1 and 3, a PCV conduit 42 is connectable to the first tube end 40 for communicating circulated gas flow from the crankcase 15 through passage 39 and into intake manifold 16 at the discharge port 43.

In the embodiment illustrated in FIGS. 2 and 3, fitting plug 30 is integral with flow tube 38 and formed of a high temperature plastic material such as a glass or mineral impregnated high temperature nylon material including Zytel or Valox manufactured by DuPont. Plug 30 also includes a stop flange 45 to engage the intake manifold 16 and prevent over insertion of PCV heater 24, as well as a sealing element such as an o-ring 44 disposed within a cooperating groove 46 formed in plug 30. In the illustrated embodiment, the press-fit engagement of the heater plug 30 with intake manifold 16 securely connects the PCV heater 24 to the intake manifold 16. Notwithstanding the above descriptions, those skilled in the art will appreciate that a variety of sealing assemblies and locking elements, such as the use of a retaining clip, may be used with the present invention without departing from the scope thereof as defined by the appended claims. Moreover, a snap or press fit engagement between the PCV heater plug 30 and intake manifold 16 may provide sufficient sealing to eliminate the need for the o-ring and groove configuration illustrated in FIG. 3.

With continued reference to FIGS. 2 and 3, PCV heater 24 includes a heating element 54 coupled to plug 30 in a thermally conductive relationship with heat sink 52. The heating element 54 in this embodiment of the invention is a ring-shaped positive temperature coefficient (PTC) ceramic element that is electrically connected to first and second lead wires 56 and 58. Specifically, a positive polarity 12-volt direct current terminal plate 60, also ring-shaped, is in contacting engagement with heating element 54 and is electrically connected to first lead wire 56. Heating element 54 is also electrically connected to heat sink 52 which in turn is electrically connected to second lead wire 58. By this arrangement, heat sink 52 functions as a 12-volt direct current negative terminal plate for completing the electric circuit between lead wires 56 and 58. It should be appreciated that numerous techniques are generally known in the art to electrically connect lead wires 56 and 58 to terminal plate 60 and heat sink 52 as well as for connecting the respective lead wires to the battery 26 via harness 28 (FIG. 1). Moreover, those skilled in the art will appreciate that heat sink 52, heating element 54, and terminal plate 60 may be coupled to one another by an electrically conductive adhesive, by a mechanical connector (such as that illustrated in FIGS. 9 and 10 and hereafter described), or by other materials or methods generally known in the art.

As illustrated in FIG. 3, heat sink 52 includes a sleeve 62 integral with an annular flange 66. Sleeve 62 is generally cylindrical in shape and extends from the lower end 36 of plug 30 along axis 32 to partially define flow tube 38. Annular flange 66 extends from sleeve 62 and partially defines the lower end 36 of plug 30.

Various design considerations dictate the specific size and configuration of heat sink 52. More particularly, the configuration of the heat sink may be modified to concentrate or direct heat to a greater or lesser extent along gas flow path 39 and lower end 36 of plug 30 as needed. Physical constraints such as the thickness, material properties, and configuration of the heating element as well as the thickness of any terminal plate 60 will also impact the configuration of heat sink 52. In the preferred embodiment, the height 68 of plug 30 is approximately 13 millimeters while the length 70 of sleeve 62 measured from an annular surface 72 of flange 66 is approximately 6–15 mm. By this description of the relative sizes of the plug 30 and sleeve 62, it should be apparent to one skilled in the art that sleeve 62 may extend beyond upper surface 34 of plug 30 (FIGS. 4 and 9) whereupon the conduit 42 may be directly connected to heat sink 52. Those skilled in the art will appreciate that the configuration of sleeve 62, when extending beyond upper end 34, may be modified to define a tube connection 73 (FIG. 4) for sliding, snap fit, or press fit engagement with conduit 42. Flange 66 extends radially from an axial surface 76 of sleeve 62 a distance 74 that is selected based upon the desired heating characteristics of heat sink 52. It is desirable to limit distance 74 and maximize an insulating distance 77 so that the insulating distance 77 of plug 30 is sufficient to prevent shorting of the circuit to manifold 16 as well as to maintain sufficient thermal insulation between the heat sink and manifold. In the illustrated embodiment, distance 77 is on the order of about at least 1 to 2 mm.

Those skilled in the art will appreciate that the relative dimensions of height 68, length 70, radial extension 74, and distance 77 may vary based upon the specific application of PCV heater 24, the composition of heating element 54, and the electrical and thermal conductive capabilities of heat sink 52. While it is generally desirable to make the PCV heater 24 and its components as large as possible for structural integrity and manufacturing ease, space constraints dictate that relatively small components are necessary. The above-described configuration beneficially concentrates heat at the lower end 36 of plug 30 in the proximity of discharge port 43 thereby maximizing the effectiveness of the PCV heater in preventing freeze-up of the flow tube as well as increasing the efficiency of the PCV heater by reducing the watt density necessary to achieve appropriate heating, saving energy, allowing the heating element to operate at cooler temperatures, and increasing reliability such as by maximizing the service life of the heating element 54.

Figure 12:
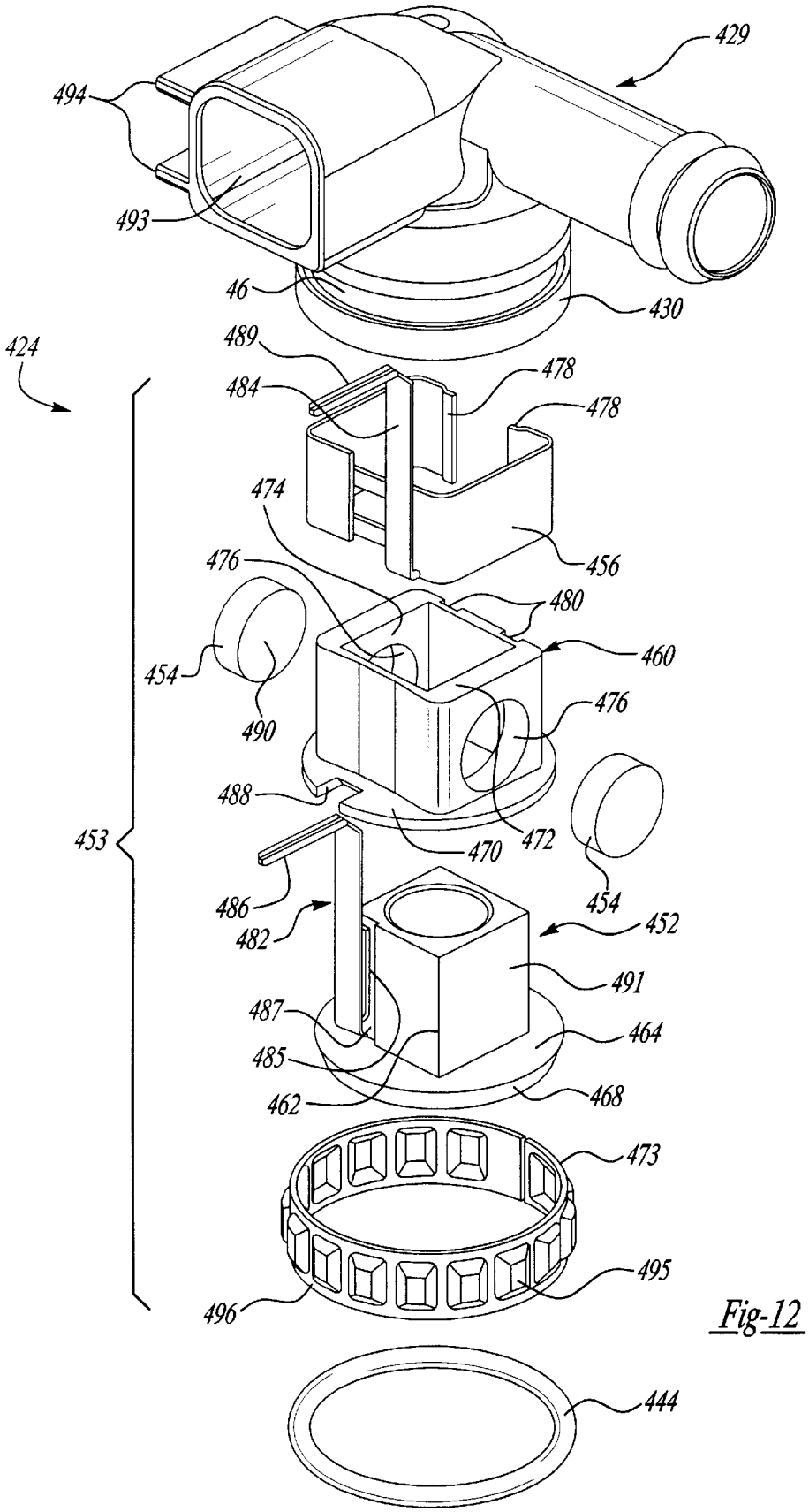
FIG. 12 is an exploded view of the fifth embodiment of the PCV heater.

The PTC ceramic heating element 54 illustrated in FIG. 3, FIG. 12, and generally described above has operational characteristics that are generally known in the art. Exemplary PTC ceramic heating elements include those manufactured by Texas Instruments of Attleboro, Me. or Control Devices of Standish, Me. PTC heating elements generally provide a self-regulating resistance in that as the temperature of the PTC heater element is increased, its resistance also increases to provide a generally constant temperature heating element. A particular PTC heating element may be selected to provide the desired temperature and heat conveyance proximate to discharge port 43.

When a PTC heating element is used, thermostatic control of the current to the heating element may not be necessary. Should a thermostat be desirable for this or other embodiments of this invention, a thermostat (not shown) may be included with PCV heater 24 or interdisposed within the electric circuit between PCV heater 24 and battery 26 in a manner generally known in the art. Those skilled in the art will further appreciate that the thermostat may be located in a variety of positions both proximate to and remote from fitting 29 without departing from the scope of the invention as defined by the appended claims. A variety of thermostats capable of regulating the current flow to the PCV heater based upon an appropriate temperature parameter are generally known in the art. A further characteristic of the PCV heaters is that they are intended to operate only during engine operation in a manner controllable through a switch mechanism (not shown) for interrupting current flow. Such switch mechanisms are also generally known in the art.

Heat sink 52 is preferably cast, stamped, or formed of a material having a relatively high thermal conductivity, greater than about 60 BTU/hour·ft$^{2}$·° F. ·ft. Specifically, heat sink 52 is preferably formed of aluminum, copper, or brass having the above thermal conductivity as well as a relatively low electrical resistivity, generally on the order of less than about 40 ohms (mil:ft), to communicate current from terminal plate 60 to lead wire 58.

For completeness, the operation of the heater 24 illustrated in FIG. 3 will now be described. During engine operation current flows between lead wires 56 and 58 and through PTC ceramic heating element 54 whereupon the electrical resistance of the heating element causes an increase in the temperature thereof. Current flowing through the heating element 54 is communicated to the lead wires via the electrically conductive heat sink 52. As heating element 54 increases in temperature, heat is communicated to heat sink 52 thereby heating the gas flow passage 39 proximate to discharge port 43 as well as the area proximate to lower plug end 36. The heated flow passage and lower end 36 inhibit condensation and freeze-up within or about the discharge port 43 of flow tube 38.

The above-recited structure and operation of PCV heater 24 provides numerous advantages over the prior art including the concentration of the heat generated by heating element 54 in an area most susceptible to freeze-up. The structure and configuration of the heating element, heat sink, and accompanying electric conductors allows reduced watt density for operation, better efficiency, energy savings, cooler operating temperatures for the heating element, and greater overall reliability of the PCV heater. The present invention also eliminates many of the manufacturing costs associated with prior art heaters as well as structural constraints such as resistance wire proximity in helical coils and wire cross-over that may lead to undesirable short circuiting of prior art heaters.

Turning now to the further embodiments of the present invention illustrated in FIGS. 4–8 and 11–13. In view of the general similarities, common reference numerals are used to refer to similar components. In general, as will be described in detail hereinafter, the second embodiment of the PCV heater illustrated in FIGS. 4 and 5 includes a thin film heating element 154. The third embodiment of the present invention illustrated in FIGS. 6 and 7 includes a heating element 254 having a resistance wire 286 helically wound about a donut-shaped support ring 288 and electrically connected to lead wires 56 and 58. The fourth embodiment of the present invention (FIG. 8) includes a resistance wire heating element 354 coupled to and in thermal relationship with a heat sink 352 which includes a spool 363 formed on sleeve 362. Finally, the fifth embodiment of the present invention, illustrated in FIGS. 11–13, includes two PTC heating elements 454 coupled to and in thermal relationship with a heat sink 452 and a clamp 456.

Figure 4:
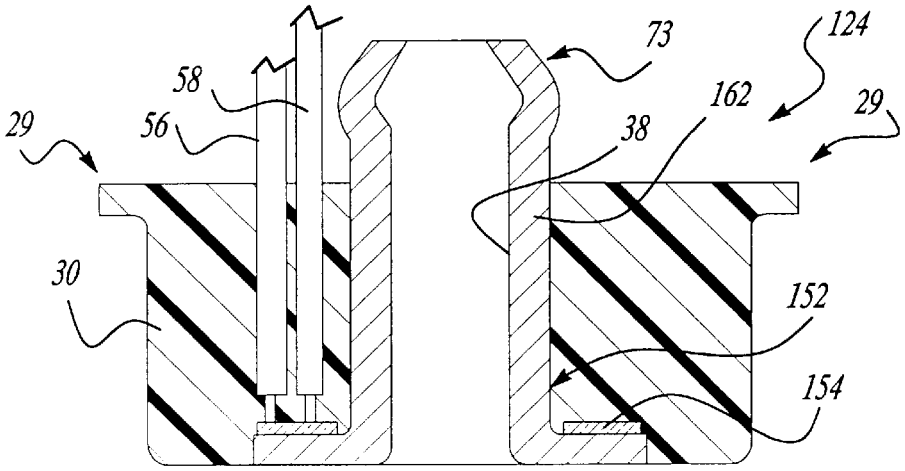
FIG. 4 is a sectional view similar to that shown in FIG. 3 but illustrating a second embodiment of the PCV heater.
Figure 5:
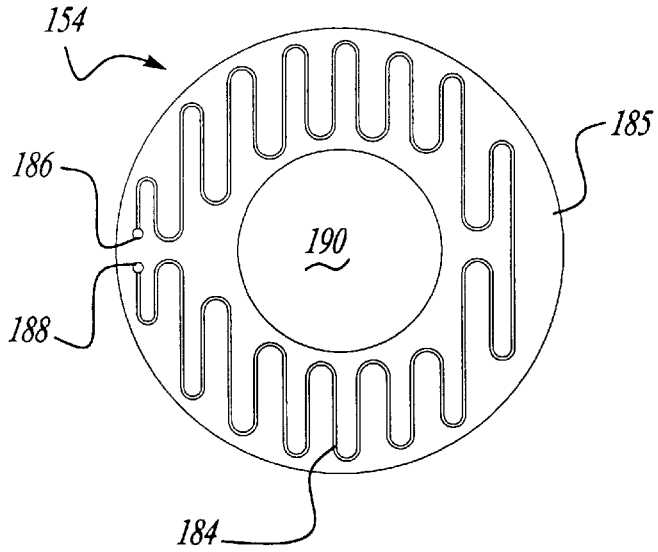
FIG. 5 is a top plan of the heating element shown in FIG. 4.

Turning now to the embodiment of the PCV heater 124 illustrated in FIGS. 4 and 5, this embodiment includes a thin film heating element 154 coupled to a heat sink 152 and electrically connected to lead wires 56 and 58. As best illustrated in FIG. 5, thin film heating element 154 includes a resistance element 184 having terminal ends 186 and 188 electrically connectable to lead wires 56 and 58, respectively, in a manner known in the art. Those skilled in the art will appreciate that the structure and operation of thin film heating element 154 is generally known in the art and that the resistance element 184 thereof may include a resistance wire, conductive and resistive etching, or equivalent heat generating element contained within an insulator 185. For example, a thin film heating element such as the flat foil heating elements manufactured by Minco of Minneapolis, Minn. under the trade name Thermalfoil™ may be used with the present invention. As best illustrated in FIG. 5, the thin film heating element 154 is generally ring shaped to define a centered aperture 190 disposable about sleeve 162 of heat sink 152. Those skilled in the art should also appreciate that various materials may be used to isolate the resistance element 184 of thin film heating element 154 including non-conductive materials such as mica.

While resistance element 184 of thin film heating element 154 is generally sufficiently electrically insulated by insulator 185, additional protection from shorting may be achieved by anodizing the heat sink material as hereinafter described. The anodized heat sink is electrically passive thereby further insulating the current flowing within resistance element 184 from conductive elements of the engine surrounding PCV heater 124 while maintaining the desired thermal conductivity. Those skilled in the art will appreciate that the configuration and composition, including the electrical resistivity and heat conductivity, of heat sink 152 may vary for specific applications of the heater.

Figure 6:
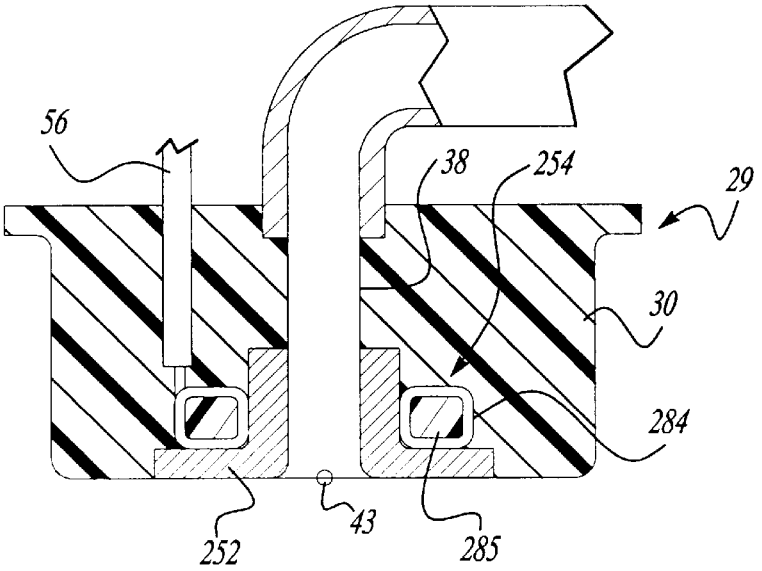
FIG. 6 is a sectional view similar to that shown in FIG. 3 but illustrating a third embodiment of the PCV heater.
Figure 7:
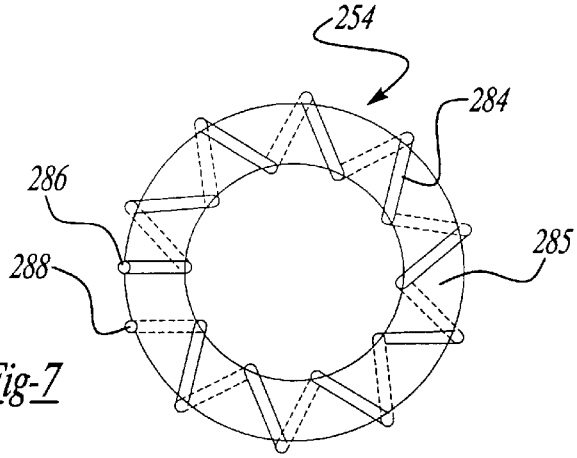
FIG. 7 is an enlarged top plan view of the heating element illustrated in FIG. 6.

Another alternate embodiment of the invention is illustrated in FIGS. 6 and 7 to include a PCV heater 224 that is similar to the above-described PCV heaters 24 and 124. More particularly, the configuration and composition of the fitting 29 is substantially the same as that described above and the heat sink 252 is preferably formed of the above-described anodized aluminum material or similar material. The anodizing of the heat sink material may be performed in a manner known in the art to create an insulative film that electrically isolates the heat sink from the conductive heating element 254. It is preferred that, when an electrically passive heat sink is desired, the anodized heat sink 152 is sufficient to pass a 600 volt dielectric test while maintaining the thermal conductivity greater than about 60 BTU/hour·ft$^{2}$·° F.·ft.

Heating element 254 illustrated in FIGS. 6 and 7 includes a resistance wire 284 helically wrapped about a support ring 285. Resistance wire 284 includes terminal ends 286 and 288 that are electrically connected to lead wires 56 and 58, respectively. By this description and the accompanying illustrations, those skilled in the art will appreciate that heating element 254 is generally a toroid shaped element wherein the size of the resistance wire 284 is selected to provide the desired resistivity, current capacity, and heat generation while satisfying the size constraints and short circuiting concerns discussed above. Those skilled in the art will further appreciate that it is generally desirable to use a resistance wire element 284 that is as large in diameter as possible for ease of manufacture and increased cross-sectional surface area.

When current from lead wires 56 and 58 is passed through resistance element 284, the element is heated. Resistance element 284 is in thermal communication with heat sink 252. The heat generated by resistance element 284 is conveyed to heat sink 252 to reduce freeze-up at and proximate to the discharge port 43. By forming heat sink 252 of the anodized material, the heat sink is electrically passive thereby preventing shorting of the resistance wire 284. The plastic plug 30 further insulates the current flowing in heating element 254 from the conductive elements of the engine surrounding PCV heater 224.

Figure 8:
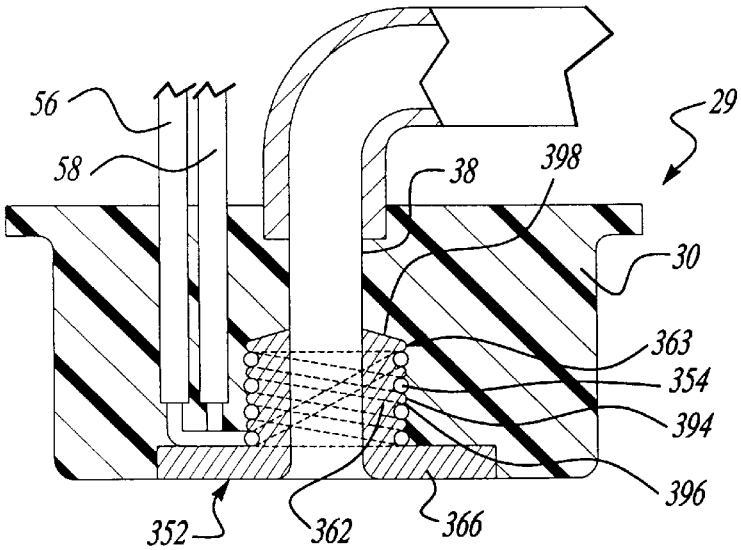
FIG. 8 is a sectional view similar to that shown in FIG. 3 but illustrating a fourth embodiment of the PCV fitting and heating element.

Another embodiment of a PCV heater 324 according to the present invention is illustrated in FIG. 8 to include a fitting 29 having a configuration and composition substantially the same as that described above. In this embodiment, heating element 354 is a resistance wire electrically connected to lead wires 56 and 58 and helically wrapped about the spool 363 formed by sleeve 362 of heat sink 352. More particularly, an outer surface 394 of sleeve 362 includes a helical groove 396 extending from an upper surface 398 of sleeve 362 and terminating proximate to flange 366. Resistance wire 354 extends from first lead wire 56 to the upper portion of the helical groove and is wrapped about the sleeve, disposed within the groove 396, and is coupled to second lead wire 58 proximate to flange 366. Those skilled in the art will appreciate that as current is passed through resistance wire 354, the wire is heated, the heat is transferred to heat sink 352 and directed via the heat sink to the areas proximate to discharge port 43.

In order to minimize the probability of shorting in the embodiment illustrated in FIG. 8, heat sink 352 is again preferably formed of an anodized aluminum material to achieve the desired heat transfer capabilities as well as resistance to current flow therethrough. More particularly, in the preferred embodiment, the anodized aluminum heat sink isolates the resistance wires while maintaining a thermal conductivity greater than about 60 BTU/hour·ft$^{2}$·° F.·ft.

Figure 11:
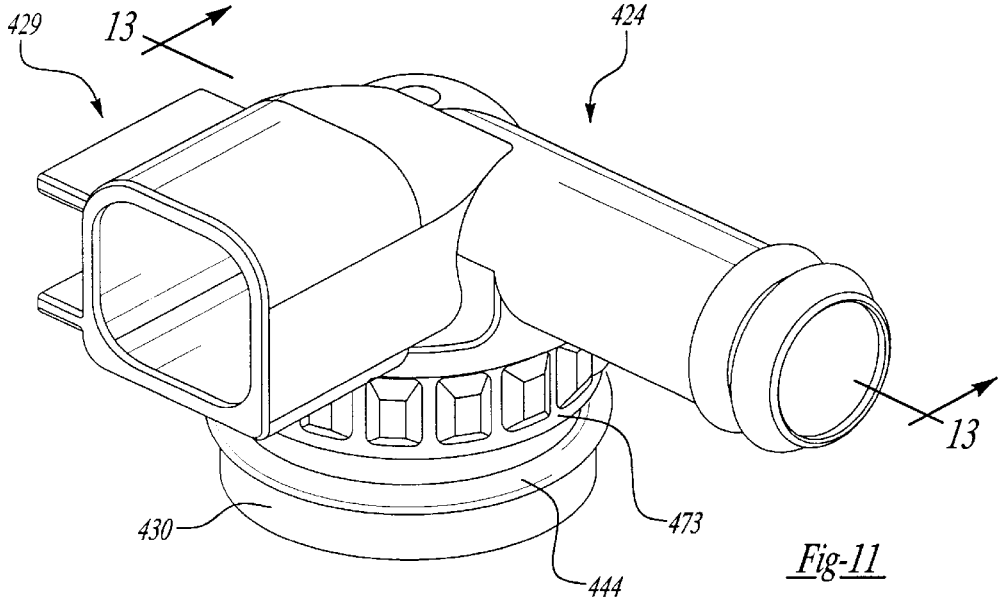
FIG. 11 is an isometric of a fifth embodiment of the PCV heater.
Figure 13:
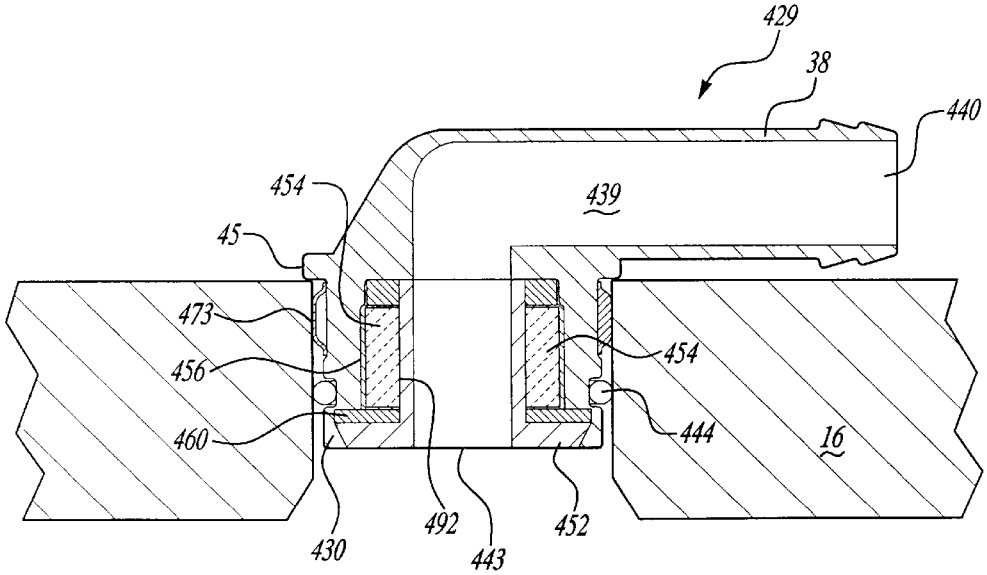
FIG. 13 is a sectional view further illustrating the fifth embodiment of the heater and generally taken along line 13—13 of FIG. 11.

Another embodiment of a positive crankcase ventilation heater 424 according to the present invention is illustrated in FIG. 11 to include a fitting 429 that is similar to the fitting 29 for the above-described PCV heaters and that includes a plug 430. Heater 424 also includes a locking element 473, sealing element 444, a heat sink 452 (FIG. 12), PTC heating elements 454 having operational characteristics as generally described above, a non-conductive housing 460, and a clamp 456. As best illustrated in FIGS. 12 and 13, heat sink 452 includes a hub 462 integral with an annular flange 464 having a tapered surface 468 that cooperates with plug 430 as shown in FIG. 13 to retain heat sink 452 within the plug. Nonconductive housing 460 includes a base 470 integral with a peripheral wall 472 that defines a cavity 474 extending through base 470. Cavity 474 is configured to accommodate hub 462 of heat sink 452 in a snug slip-fit arrangement. Peripheral wall 472 further includes a pair of openings 476 communicating with cavity 474 and configured to accommodate PTC elements 454. One skilled in the art will appreciate that the size and shape of openings 476 may be varied to accommodate different configurations of PTC heating elements in order to meet various design criteria.

As shown in FIGS. 12 and 13, clamp 456 surrounds housing 460 to biasingly urge heating elements 454 into electrical and thermal contact with both clamp 456 and heat sink 452. Clamp 456 further includes retention tabs 478 (FIG. 12) that lockingly engage grooves 480 formed in housing 460. Heater 424 further includes terminals 482 and 484 for electrically connecting the heater 424, including the heating elements 454 and heat sink 452, to a power source in a manner similar to the lead wires described above with reference to heater 124. Specifically, terminal 482 is electrically coupled to heat sink 452 and electrically insulated from clamp 456 by housing 460 after assembly of the heater as hereinafter described (FIG. 13). More specifically, terminal 482 includes a tang 485 and a post 486. Tang 485 cooperates with an offset surface 487 of heat sink 452 and is biasingly engaged between housing 460 and heat sink 452 after assembly of the heater. Housing 460 includes a slot 488 formed in base 470 to orient terminal 482 relative to housing 460. Second terminal 484 is integral with clamp 456 and terminates at a post 489. After heater 424 is assembled and coupled to a power source, current supplied to the terminals pass through clamp 456, heating elements 454, and heat sink 452.

Those skilled in the art will appreciate that as current passes through PTC elements 454, the elements are heated and heat is transferred to heat sink 452 providing localized heating of the discharge port 43 (FIG. 13). Heater 424 is configured to include a heater subassembly 453 including heat sink 452, housing 460, heating elements 454, and clamp 456 that may be easily shipped and overmolded by a plastic injection molder to form fitting 429 about the heater subassembly. Specifically, the placement of heat sink hub 462 within housing cavity 474, positioning of heating elements within housing openings 476 and attachment of clamp 456 to housing 460 as described above provides a secure subassembly for overmolding.

Heating elements 454 are preferably disc shaped having planar sides 490. The disc-shaped configuration of heating elements 454 and planar shape of a heat sink hub surface 491 ensures that the heating elements and heat sink contact along a planar contact surface 492 (FIG. 13) under the biasing force of clamp 456. The planar contact ensures a sufficient surface area for thermal and electrical conductivity between the heating elements 454 and heat sink 452.

Fitting 429 is illustrated to include a flow tube 38 and stop flange 45 similar in function and shape to that previously described and, in cooperation with heat sink 452, defines a gas flow path 439 having a first end 440 and a second end defining discharge port 443. Additionally, during overmolding the fitting is provided with a receptacle 493 and clip retainers 494 (FIG. 12). Receptacle 493 protects posts 486 and 489 of terminals 482 and 484, respectively, from physical damage and exposure to the engine compartment environment. Upon connection of an external power cord (not shown) to the posts, clip retainers 494 couple the power cord to fitting 429.

As shown in FIGS. 11–13, locking element 473 includes multiple spring pads 495 projecting from a surface 496. Upon installation of fitting 29 into intake manifold 16, spring pads 495 compress and biasingly engage manifold 16 thereby removably coupling the fitting to the manifold. Those skilled in the art will appreciate that a variety of coupling mechanisms known in the art may be used in lieu of locking element 473 without departing from the scope of the invention as defined by the appended claims.

From the foregoing description and the attached claims and drawings, those skilled in the art will appreciate that the various embodiments of the present invention provide a PCV heater having numerous advantages over the prior art. More particularly, the PCV heater of the present invention advantageously reduces the probability of shorting during operation, provides a heater design that is more simple and inexpensive to manufacture and that includes a heating element and heat sink that concentrates the heat in the area of freeze-up. Accordingly, the present invention generates heat to minimize freeze-up with better efficiency and lower required wattage than prior art devices. Corresponding manufacturing cost savings and energy savings during operation are particularly advantageous in view of the operational benefits provided by the invention.

With specific reference to FIGS. 9 and 10, a method of manufacturing the above-described PCV heaters 24, 124, 224, 324, and 424 will be described. While this method will be described with specific reference to PCV heater 24 having PTC ceramic heating element 54, such as that described with reference to FIGS. 2 and 3, those skilled in the art should appreciate that the method is equally applicable to the other described embodiments.

Figure 9:
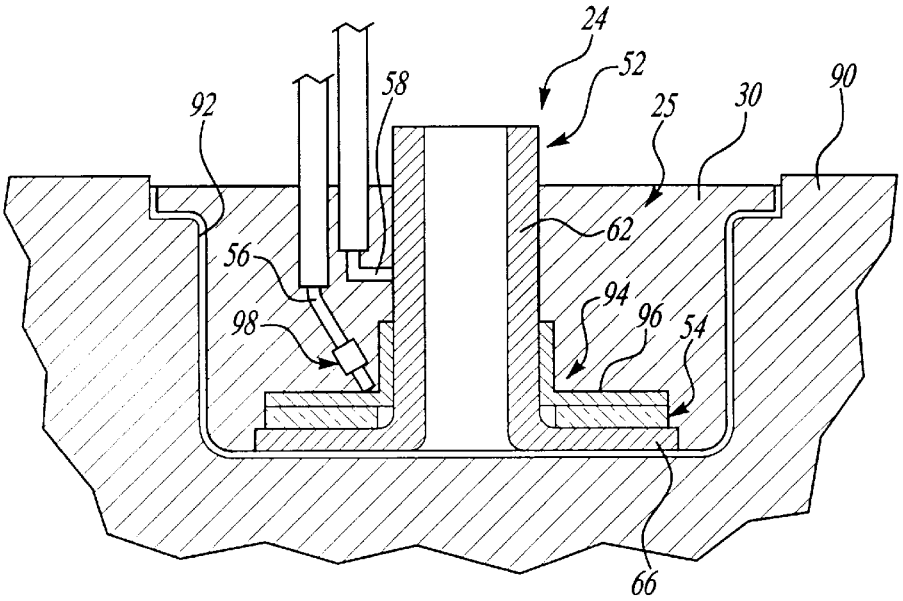
FIG. 9 is a sectional view of a PCV heater and mold for forming the plug about the heat sink, mechanical connector, and heating element illustrated in FIG. 10.
Figure 10:
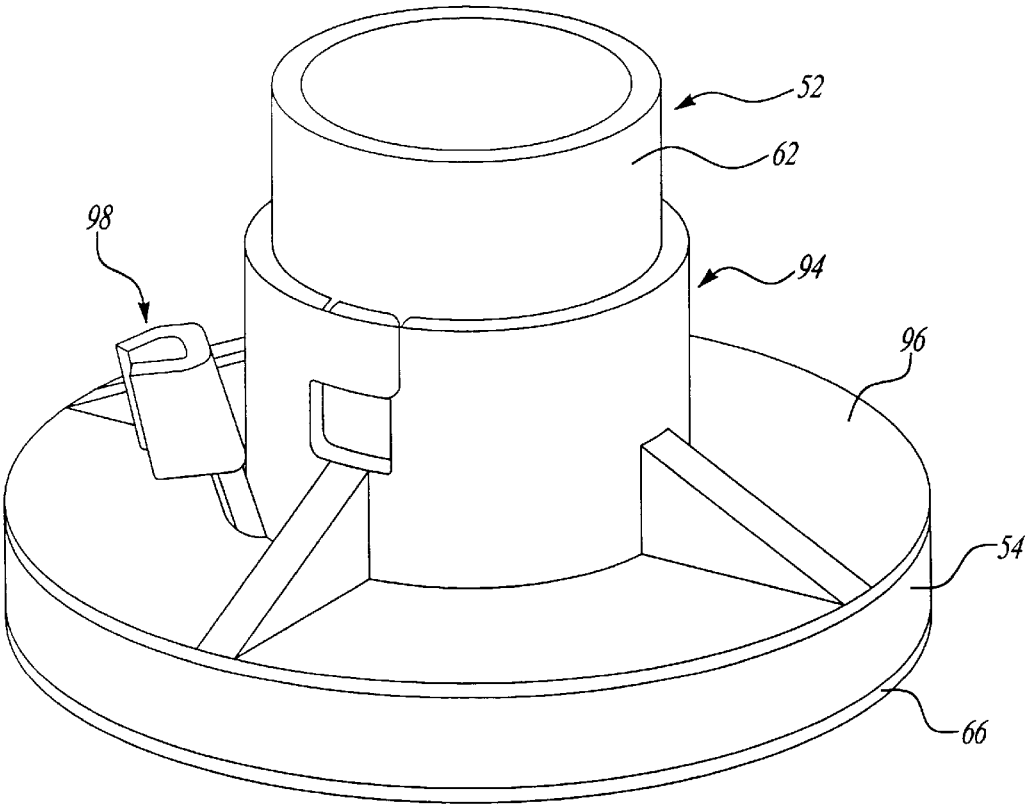
FIG. 10 is a perspective view of a mechanical connector for positioning the heating element relative to the heat sink.

The method of manufacturing heater 24 includes creating a heater subassembly 25 by placing an appropriately sized PTC ceramic heating element 54 upon heat sink flange 66 in the manner shown in FIGS. 9 and 10. A flange 96, functioning as terminal plate 60 (FIG. 3), is disposed about sleeve 62 and urged into electrical engagement with heating element 54 by a mechanical fastener coupled to sleeve 62 in a manner generally known in the art. Flange 96 preferably also includes a lead wire connector 98 for coupling lead wire 56 to flange 96. Second lead wire 58 is coupled to sleeve 62 in a manner generally known in the art as illustrated in FIGS. 3 and 9.

After the heat sink 52, heating element 54, mechanical fastener 94, and lead wires 56 and 58 are connected in the manner illustrated and described, heater subassembly 25 is disposed within a properly configural mold 90 defining a mold cavity 92. Subsequently, a high temperature plastic material is placed into the mold cavity to form plug 30. Those skilled in the art will appreciate that the mechanical fastening of fastener 94 to heat sink 52 secures the position of heating element 54 relative to heat sink 52 for the overmolding of plastic material. After the molding process is complete, the overmolded plastic assists in maintaining the structural integrity of heater 24.

Those skilled in the art will also appreciate that while the above method of manufacture is illustrated and described as including mechanical fastener 94, other materials such as adhesives may be used to secure the heating element relative to the heat sink without departing from the scope of the invention as defined by the appended claims. Moreover, the above-described method of manufacturing a PCV heater may be used with each of the above-described heater embodiments. Specifically, with regard to heater 424, the method includes forming heater subassembly 453 as previously described, placing the subassembly in a mold cavity, and overmolding the subassembly such as with the above-described high temperature plastic material.

Various other advantages will become apparent to those skilled in the art after having the benefit of studying the foregoing text and the appended drawings, taken in construction with the following claims.

What is claimed is:

1. An internal combustion engine comprising:

a crankcase;

an intake manifold; and a positive crankcase ventilation system for selectively circulating gases from the crankcase to the intake manifold, said positive crankcase ventilation system communicating with said intake manifold to define a mixing zone where said circulated gases are mixed with ambient air from said intake manifold, said positive crankcase ventilation system including a heater coupled to said engine proximate to said mixing zone, said heater having a fitting having a plug, a heat sink coupled to said fitting, said fitting and heat sink defining a gas flow path having a first end and a second end, said second end defining a discharge port communicating with the mixing zone, said heat sink being in heat exchange relationship with said discharge port, and a heating element coupled to said fitting and being electrically connectable to a power source, said heating element thermally engaging said heat sink to communicate heat from said heating element to said heat sink.

2. The internal combustion engine of claim 1 wherein said heating element is a positive temperature coefficient ceramic.

3. The internal combustion engine of claim 1 wherein said fitting is formed of a high temperature plastic that thermally isolates said heat sink from said manifold.

4. The internal combustion engine of claim 1 wherein said plug includes a groove and wherein said heater includes a sealing element disposed in said groove sealingly engaging said intake manifold.

5. The internal combustion engine of claim 1 wherein said heat sink includes a tapered surface coupled to said plug to retain said heat sink within said plug.

6. The internal combustion engine of claim 1 wherein said heater includes a clamp coupling said heating element in thermal engagement with said heat sink.

7. The internal combustion engine of claim 6 wherein said heater includes a non-conductive housing positioned between said heat sink and said clamp, said housing having a wall defining a cavity and an opening in said wall that communicates with said cavity, said heat sink disposed in said cavity and said heating element disposed in said opening to thermally engage said heat sink.

8. The internal combustion engine of claim 7 wherein said housing includes a groove and wherein said clamp includes a tab coupled to said groove.

9. The internal combustion engine of claim 7 wherein said heat sink includes a heating surface in planar engagement with said heating element.

10. The internal combustion engine of claim 7 wherein said clamp has a first terminal and said heat sink has a second terminal such that a current circuit flows from said power source through said first terminal, said clamp, said heating element, said heat sink, and said second terminal.

11. The internal combustion engine of claim 7 wherein said heater includes a locking element engaging said plug and said intake manifold to couple said heater to said intake manifold.

12. A positive crankcase ventilation heater comprising:

a fitting having a plug;

a heat sink coupled to said fitting, said fitting and heat sink defining a gas flow path having a first end and a second end, said second end defining a discharge port, said heat sink being in heat exchange relationship with said discharge port; and a heating element coupled to said fitting and being electrically connectable to a power source, said heating element thermally engaging said heat sink to communicate heat from said heating element to said heat sink.

13. The heater of claim 12 further including a clamp and a non-conductive housing, said housing having a wall defining a cavity and an opening in said wall that communicates with said cavity, said heat sink disposed in said housing cavity, said heating element disposed in said opening, and said clamp coupled to said housing to urge said heating element into engagement with said heat sink.

14. The heater of claim 13 wherein said heating element engages said heat sink along a planar contact surface.

15. The heater of claim 12 wherein said plug is formed of a high temperature plastic.

16. The heater of claim 12 wherein said heat sink is formed of a material having a heat conductivity of at least about 60 BTU/hour·ft$^{2}$·° F.·ft and an electrical resistivity of less than about 40 ohms (mil:ft).

17. The heater of claim 12 wherein said heating element is a positive temperature coefficient ceramic.

18. A method for manufacturing a positive crankcase ventilation heater comprising the steps of:

forming a heater subassembly including coupling a heating element in heat transfer relationship to a heat sink and electrically connecting a first terminal and a second terminal to said heating element;

placing said heater subassembly in a mold defining a cavity; and providing an electric insulating material to said cavity to overmold said heater subassembly and form a fitting about said heater subassembly.

19. The method of claim 18 further including coupling a nonconductive housing to said heat sink prior to placing said heater subassembly in said mold cavity.

20. The method of claim 19 further including coupling a clamp to said nonconductive housing to urge said heating element into engagement with said heat sink.

* * * * *